US008042729B2

(12) United States Patent
Dinh

(10) Patent No.: US 8,042,729 B2
(45) Date of Patent: Oct. 25, 2011

(54) MAILBOX TRAY

(76) Inventor: Tuan Quoc Dinh, Rochester, NY (US)

( * ) Notice: Subject to any disclaimer, the term of this patent is extended or adjusted under 35 U.S.C. 154(b) by 93 days.

(21) Appl. No.: 12/714,332

(22) Filed: Feb. 26, 2010

(65) Prior Publication Data

US 2011/0210166 A1 Sep. 1, 2011

(51) Int. Cl.
*A47G 29/12* (2006.01)

(52) U.S. Cl. ..... 232/29; 232/17

(58) Field of Classification Search ..... 232/29, 232/33, 17, 45; 312/334.7, 334.21; 220/23.87, 220/23.89, 528; 206/557, 514
See application file for complete search history.

(56) References Cited

U.S. PATENT DOCUMENTS

| | | | | | |
|---|---|---|---|---|---|
| 908,543 | A | | 1/1909 | Brown | |
| 2,760,721 | A | | 8/1956 | Roberts | |
| 4,714,192 | A | * | 12/1987 | Harlow et al. | 232/17 |
| 4,753,385 | A | * | 6/1988 | Phipps et al. | 232/17 |
| 4,896,827 | A | * | 1/1990 | Economou | 232/17 |
| 4,932,587 | A | * | 6/1990 | Robbins | 232/17 |
| 5,009,366 | A | * | 4/1991 | van Druff et al. | 232/17 |
| 5,271,555 | A | * | 12/1993 | Mayer | 232/17 |
| 5,425,501 | A | * | 6/1995 | Wesorick | 232/17 |
| 5,765,749 | A | * | 6/1998 | Harper | 232/17 |
| 5,775,578 | A | * | 7/1998 | Baxi et al. | 232/17 |
| 6,698,651 | B1 | | 3/2004 | Green | |
| 6,997,373 | B2 | * | 2/2006 | Flores | 232/29 |
| 7,000,826 | B2 | * | 2/2006 | Billings | 232/29 |
| 7,004,380 | B2 | | 2/2006 | Gunvaldson | |
| 2005/0247770 | A1 | * | 11/2005 | Priest | 232/20 |

* cited by examiner

*Primary Examiner* — William L. Miller
(74) *Attorney, Agent, or Firm* — Tracy Jong Law Firm; Tracy P. Jong; Cheng Ning Jong

(57) ABSTRACT

A mailbox tray mountable to a standard mailbox, the mailbox tray having a bracket arm and a substantially thin generally rectangular slideable tray. The tray has a mail-facing surface disposed substantially parallel to the top surface of the bottom panel of the mailbox. The slideable tray portion has a depression to facilitate mail gripping and removal. A mail-facing surface has one or more drain holes and at least one ridge. The first end of the bracket arm is pivotably connected to the front door and the second end of the bracket arm is pivotably connected to the slideable tray such that when the front door is opened, at least a portion of the slideable tray is extended outside of the cavity and when said front door is closed, the slideable tray is returned in its entirety inside of the cavity. In a second embodiment, the slideable tray further comprises a first segment and a second segment which are pivotably connected. When the front door is opened, the rear end of the second segment is substantially raised such that the mail-facing surfaces of the front and rear segments collectively form a concave configuration. When the front door is closed, the rear segment returns to a plane substantially coplanar with the front segment.

7 Claims, 7 Drawing Sheets

MAILBOX TRAY

PRIORITY CLAIM AND RELATED APPLICATIONS

This application claims the benefit of priority from non-provisional application U.S. Ser. No. 29/311,303 entitled "Mailbox" filed on Feb. 12, 2009. Said application is incorporated by reference in its entirety.

BACKGROUND OF THE INVENTION

1. The Field of the Invention

The present invention relates generally to mailbox inserts and, more specifically, to a slideable tray mountable within a roadside mailbox which partially extends as the mailbox door is opened and retracts when the door is closed.

2. Background Art

Numerous mailbox designs and configurations have been attempted in the past to provide easier access to the mail piece. A traditional basic mailbox comprises a substantially rectangular box having two side panels, a top panel, a bottom panel, a rear panel and pivotably openable and closeable front door. The top panel is traditionally formed of a convex or arched panel to discourage rain water, dirt, or snow collection while the front door and rear panel are shaped to conform to the curvature of the top panel.

U.S. Pat. No. 6,698,651 discloses a tray and track assembly for a typical rural mailbox having a track frame attached to the mailbox bottom with longitudinal rails for receiving and guiding a pair of track members on the bottom of a tray. Two extension arms are pivotally attached to the sidewalls of the tray, and attached to the inside of the hinged mailbox front door. When the front door is opened the extension arms pull the tray forward on the track frame until stop members on the track frame and tray halt the forward movement of the tray. A part of the tray is then beyond the interior of the mailbox. The extension arms push the tray back into the mailbox when the front door is closed. Ridges elevate the mail piece above condensation that forms on the tray bottom, and drain holes in the tray allow such liquids to drain. The tray comprises sidewalls and rear panel are substantial in construction and span a significant portion of the interior cavity height of the mailbox. Furthermore, the sidewalls present obstruction to visual identification of the mail piece and physical obstruction to removal of the mail piece. A user is required to align his/her hand in the direction of the tray opening in order to remove a mail piece disposed in the tray. A substantial portion of the interior volume of the mailbox is consumed by having a separate walled tray, thereby reducing the usable interior space of the mailbox.

U.S. Pat. No. 7,004,380 discloses a sliding, guided tray that is mountable within a standard, rural mailbox. The tray extends from the mailbox when the mailbox door is opened, and retracts back within the mailbox when the mailbox door is closed. The guided mailbox tray assembly includes a tray. Preferably, the tray is cut out and bent into the form of a rectangular box from a single sheet of galvanized metal. The tray has a side panel and a runner slot cut within the side panel. A runner with a slot fastener end, and a bracket fastener end that is slidingly mountable into the runner slot. A bracket is mountable to the openable door of the mailbox. The bracket includes a runner fastener that is hingeably attachable to the bracket fastener of the runner. The tray has a pair of side panels, each with a runner slot, a pair of runners, each with a slot fasteners and bracket fasteners, for slidingly connecting the runners to the tray, and pivotably connecting the bracket to the runners. The tray of this mailbox also comprises side panels and rear panel that are substantial in construction and span a significant portion of the interior cavity height of the mailbox. Though tapered towards the tray opening, the side panels present obstruction to visual identification of a mail piece disposed within the tray and physical obstruction to removal of the mail piece. These tasks are further complicated by intrusive bracket arms and runners disposed substantially close to the tray opening. A user is required to align his/her hand in the direction of the tray opening in order to remove a mail piece disposed in the tray. The walled tray is also space consuming and unnecessarily limiting the free space available within the mailbox.

A mail piece is typically delivered to or deposited in a mailbox by simply tossing the mail piece inside the mailbox with its broadside landing on top of the bottom panel. Since the mail piece lays flat on the bottom panel, this presents a challenge for gripping and retrieving the mail piece. U.S. Pat. No. 6,698,651 contemplates using ridges to elevate a mail piece to avoid being damaged by moisture condensation that forms on the tray surface. These ridges however are not sufficiently raised to provide a sufficient gap between the bottom of the mail piece and the bottom panel such that a hand or fingers can be inserted to facilitate mail gripping and removal. The concept of disposing ridges on the bottom panel therefore does not teach a means to facilitate gripping of mail disposed on the bottom panel.

U.S. Pat. No. 908,543 discloses a mailbox whose receptacle is moved nearly entirely outside and tilted outside of the mailbox. The receptacle comprises a box, a tray slideable within the box, a door for closing the box and having connection with the tray to slide the same either within or without the enclosure to facilitate placing of the mail piece in the tray or removal of matter therefrom, means for securing the cover when closed, and a signal, the latter being actuated by the cover to insure its displacement each time the cover is opened, so that the signal may be set only when the box contains matter either to be collected or deposited for the resident. Though the tray is tilted when the door is opened, the problem of gripping and retrieving a mail piece, especially a single thin mail piece, remains unsolved. The receptacle again comprises sidewalls, a rear panel and a front panel which are substantial in construction and span a significant portion of the interior cavity height of the mailbox. Furthermore, the receptacle design that enables nearly the entire receptacle to tilt outside of the mailbox cavity also requires that that receptacle be mounted at a location substantially elevated with respect to the mailbox cavity, thereby robbing the mailbox of valuable space and making the mailbox unsuitable for receiving larger articles.

U.S. Pat. No. 2,760,721 discloses a mailbox having a letter rack comprising a relatively narrow troughshaped or U-shaped letter receptacle which makes it easier to insert letters into and to pick these letters out of the receptacle. The forward end of the letter receptacle is pivotally secured to the door near one edge of the door. The rear end portion of the letter receptacle is swingingly supported by a link. The receptacle is narrow and it is designed to hold mail pieces erected on their lengthwise side. Contrary to the present invention, in order to use the prior art mailbox receptacle, one must bunch up a plurality of mail pieces and insert them neatly into the receptacle. This extra step is time consuming and would discourage the use of such a receptacle altogether in circumstances where speed is of the essence.

SUMMARY OF THE INVENTION

The limitations of the prior art are overcome by a novel mailbox tray. A standard roadside mailbox typically has a cavity and comprises two sidewalls, a depending top panel, a depending bottom panel, a depending rear panel and a front door pivotably connected to the bottom panel. In accordance to the present invention, there is provided a slideable tray that is substantially thin and having a sliding means disposed substantially parallel to and on top of the bottom panel of a mailbox, at least a bracket arm with its first end pivotably connected to the front door of a mailbox and its second end to the slideable tray such that when the front door is opened, the slideable tray is extended partially outside of the mailbox cavity and retracted into the mailbox cavity when the front door is being closed.

In a second embodiment, there is provided a slideable tray that is substantially thin and disposed substantially parallel to and on top of the bottom panel of a mailbox when the front door is closed, at least a bracket arm with its first end pivotably connected to the front door and its second end to the front end of the slideable tray such that when the front door is opened, the slideable tray is extended partially outside of the mailbox cavity and retracted into the mailbox cavity when the front door is being closed. In this second embodiment, the tray instead comprises a front segment and a rear segment operably connected to a first sliding means and a second sliding means, respectively. When the front door is opened, the first segment partially extends via the first sliding means in a plane substantially parallel to the bottom panel while the rear end of the second segment advances towards the front door and rises via the second sliding means such that the rear segment creates a concave relationship with the first segment.

In both of the embodiments, the tray further comprises at least one depression sufficient to accommodate human fingers and disposed at one portion of the mail-facing surface of the slideable tray. It is yet another feature of the present invention to provide at least one drain hole on one continuous mail-facing surface for moisture drainage. It is yet another feature of the present invention to provide a means to elevate a mail piece such that the mail piece does not contact a mail-facing surface for the most part.

It is a primary object of the present invention to provide a mailbox tray to facilitate easier viewing and identification of the mailbox contents prior to retrieval, and to allow such viewing from a location to the side of, rather than in front of, the mailbox.

It is another object of the present invention to enhance the safety of a user when using a roadside mailbox.

It is another object of the present invention to provide a mailbox tray that improves the process of retrieving mail contents from a mailbox, and especially, in making it easier to grasp the mail when it is lying flat or disposed parallel to the bottom surface of the mailbox.

It is another object of the present invention to provide a mailbox tray that improves the process of retrieving mail contents from a mailbox for those with limited hand/finger dexterity or those wearing gloves.

It is yet another object of the present invention to provide a mailbox tray that improves the process of mail delivery to a mailbox.

It is yet another object of the present invention to provide a mailbox tray that does not severely reduce or otherwise affect the mail-accommodating volume of a mailbox.

It is yet another object of the present invention to provide a simple and intuitive mailbox tray that facilitates the depositing of a delivery and subsequent securement and removal of the delivery from a mailbox.

Whereas there may be many embodiments of the present invention, each embodiment may meet one or more of the foregoing recited objects in any combination. It is not intended that each embodiment will necessarily meet each objective. Also it is to be understood that the phraseology and terminology employed herein are for the purpose of description and should not be regarded as limiting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
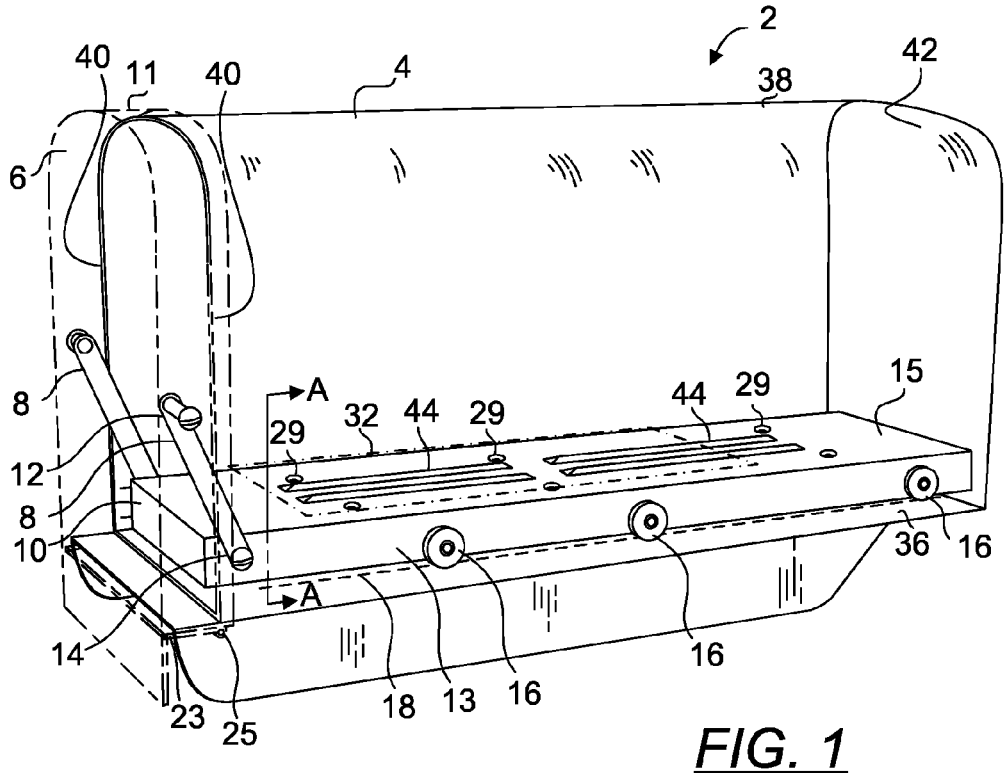
FIG. 1 is a partially transparent top front perspective view of a first embodiment of the present invention mounted in a mailbox, illustrating the spatial relationship of a slideable tray with respect to a closed front door.

The drawings are not to scale, in fact, some aspects have been emphasized for a better illustration and understanding of the written description.

PARTS LIST

2—mailbox
4—mailbox body
6—front door

8—bracket arm
10—slideable tray
11—front door lip portion
12—front door-bracket arm pivot
13—tray sidewall
14—tray-bracket arm pivot
15—mail-facing surface of slideable tray
16—level roller
17—tilt track angle
18—level track
19—slide guide
20—tilt track
21—slide guide slot
22—tilt roller
23—hinge leaf
24—rear segment
25—front door hinge
27—cabinet drawer slide
27*a*—cabinet member
27*b*—drawer member
28—depression
28*a*—ridge formed from two depressions
29—hole
30—mailbox door handle
31—sliding edge of rear segment
32—mail piece
34—edge of mail
36—bottom panel
38—top panel
40—sidewall
42—rear panel
44—ridge
46—hinge
46*a*, 46*b*—hinge leaf
46*c*—pin
48—first segment
50—position of second segment when front door is fully closed
52—position of second segment when front door is fully open
54—slot
56—sliding pin

PARTICULAR ADVANTAGES OF THE INVENTION

The present invention provides a mailbox tray that is installed in a mailbox. The mailbox tray simplifies the identification, securement and removal of a mail piece by moving the mail piece partially outside of the mailbox when the front door of the mailbox is opened. This allows a user to visualize and ascertain the mailbox contents before retrieving them, providing a means of avoiding undesirable contact with hidden animals, broken glass, and other objects which may be objectionable.

This also allows a user to visualize the contents from a position that it next to, rather than directly in front of, the mailbox. As mailboxes are disposed along the roadside, a user is potentially in a dangerous position in the path of vehicle travel when retrieving the daily mail. Where the contents can be retrieved easily from the side of the mailbox, safety for the user is greatly enhanced, especially along busy streets.

In contrast to the prior art, the tray of the present invention is devoid of substantial side and rear walls arising from the tray surface, which can not only obstruct view of the mail piece but also securement and subsequent removal of the mail piece from the tray. The tray contains a built-in depression in a portion of the tray which allows a user's fingers to get in between the tray and the mail piece. In the second embodiment, the gap afforded by the built-in depression is further enlarged such that retrieval of the mail piece is made even easier. This is especially advantageous for users with limited dexterity or those wearing gloves.

The tray of the present invention is also substantially non-intrusive and simple in construction compared to the prior art, thereby taking up less valuable space in the mailbox and retaining most of the cavity volume for mail storage.

The present invention provides a mailbox tray that simplifies the depositing, securement and removal of a mail piece but yet is easy and intuitive to use. As disclosed in U.S. Pat. No. 2,760,721, an attempt was made in providing a mailbox having a rack disposed internally on a sidewall to collect outgoing mail pieces such that they may be more easily and quickly retrieved. While the rack may make mail retrieval easier, the prior art does not accommodate the practice of mail carriers. Mail carriers must quickly deposit mail in the box and thus may avoid additional effort to carefully align mail in a rack configuration and instead deliver mail by tossing a mail piece or mail pieces on the bottom panel. In contrast to the prior art, the present invention provides a mailbox tray that enables easy drop-off, depositing and retrieval of a mail piece or mail pieces by providing a mailbox tray that extends partially outside of the mailbox. This is advantageous in eliminating mail from falling to the ground easily during mail delivery activities.

DETAILED DESCRIPTION OF A PREFERRED EMBODIMENT

FIG. 1 is a partially transparent top front perspective view of a first embodiment of the present invention mounted in a mailbox 2, illustrating the spatial relationship of a slideable tray 10 with respect to a closed front door 6. A standard mailbox 2 generally comprises a generally elongated cavity defining mailbox body 4 having two sidewalls 40, a depending top panel 38, a depending bottom panel 36 and a depending rear panel 42, and a front door 6 pivotably connected to and disposed on one lengthwise end of the bottom panel 36. In accordance with the present invention, a slideable tray 10 having a sliding means and a pair of bracket arms 8 connecting the front door 6 to the slideable tray 10 is disclosed. While the front door 6 is closed (as depicted in FIG. 1), the bracket arms 8 return the slideable tray 10 in its entirety into the mailbox cavity to its resting position.

The mailbox front door 6 is a generally flat structure having a lip portion 11 disposed on its side and top peripheries and a pivotal means (not shown) disposed on its bottom periphery. The top panel 38 is generally arched to naturally reduce snow or debris collection on its upper surface.

The slideable tray 10 has a generally flat mail-facing surface 15 substantially the size of the bottom panel 36 and two short depending sidewalls 13 extending downwardly from the mail-facing surface 15. A mail piece 32 is shown (in broken lines) disposed on the mail-facing surface 15 of the slideable tray 10. In use, the longitudinal edges of the mail-facing surface 15 come in sliding abutment with the sidewalls 40, thus leaving little chance for a mail piece 32 to fall between the slideable tray 10 and the sidewalls 40. As such, raised tray sidewalls such as those mentioned previously in prior art are rendered unnecessary and unfavorable.

Each bracket arm 8 is formed of an elongated rod or plate having a first end 12 and a second end 14. A hole is disposed on each end of a bracket arm 8. A hole is also disposed on the lip portion 11 of each side periphery of the front door. Similarly, a hole is disposed on each of the slideable tray sidewalls 13. A screw and nut combination is used to pivotably attach the first end 12 of each bracket arm 8 to the front door 6 at one side periphery of the front door 6 where a hole is disposed. Similarly, a screw and nut combination is used to pivotably attach the second end 14 of each bracket arm 8 to a slideable tray sidewall 13 where a hole is disposed. As will be readily appreciated, various other means of attachment may be suitable used and considered within the scope of the invention. These include, for example, double-sided tapes, adhesives, pins, rivets, ball joint and pivot cup combination and the like may also be used to form pivoting joints such as those made between the front door 6, bracket arms 8 and slideable tray sidewalls 13.

The slideable tray 10 further comprises a set of two level tracks 18 which are disposed at a substantially parallel relationship to the top surface of the bottom panel 36. In a preferred embodiment, each of the level tracks 18 is fixedly attached to a sidewall 40. In another embodiment, each of the level tracks 18 is fixedly attached to the top surface of the bottom panel 36. On each slideable tray sidewall 13, there is disposed a plurality of rollers 16 configured to permit rolling action in the longitudinal direction of the slideable tray 10. The details of the slideable tray sliding means is further described in the ensuing drawings.

There are further provided a plurality of drain holes 29 and ridges 44 on the mail-facing surface 15 of the slideable tray 10. The ridges 44 help elevate the mail piece 32 above the mail-facing surface to minimize contact of mail piece 32 with any moisture or water from melted snow that may collect on the mail-facing surface 15. The drain holes 29 help dispose of any moisture or pool of water that may otherwise collect on the mail-facing surface 15.

Figure 2:
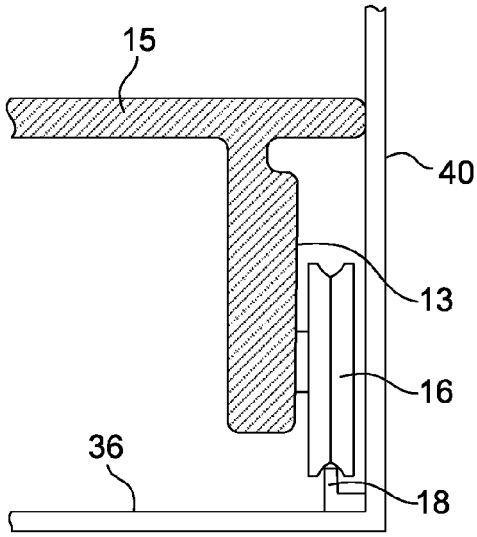
FIG. 2 is a partial front orthogonal cutaway view of the slideable tray and its sliding means taken along line AA on the slideable tray of FIG. 1.

FIG. 2 is a partial front orthogonal cutaway view of the slideable tray 10 and its sliding means taken along line AA on slideable tray 10 of FIG. 1. A roller 16 having a gothic arch groove profile is shown disposed on a level track 18. The roller 16 is allowed to freely roll on top of the level track 18. The mail-facing surface 15 is shown to come in sliding abutment with the sidewall 40.

Figure 3:
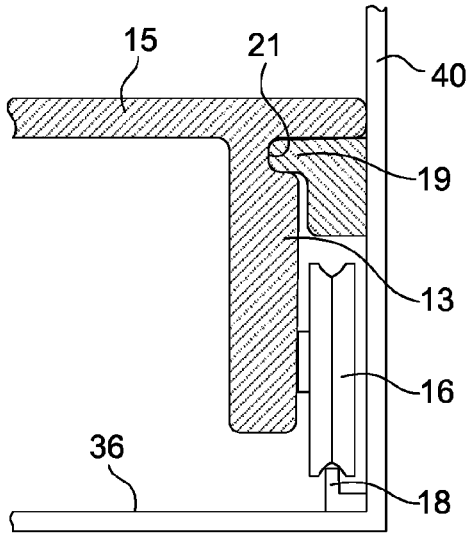
FIG. 3 is a partial front orthogonal cutaway view of another embodiment of the slideable tray and its sliding means.

FIG. 3 is a partial front orthogonal cutaway view of another embodiment of the slideable tray 10 and its sliding means. In this embodiment, a slide guide 19 and slide slot 21 combination is provided. The slide guide 19 is fixedly attached to sidewall 40 and seated in the slide slot 21 to prevent the slideable tray 10 from dislodging from the level track 18 while in use.

Figure 4:
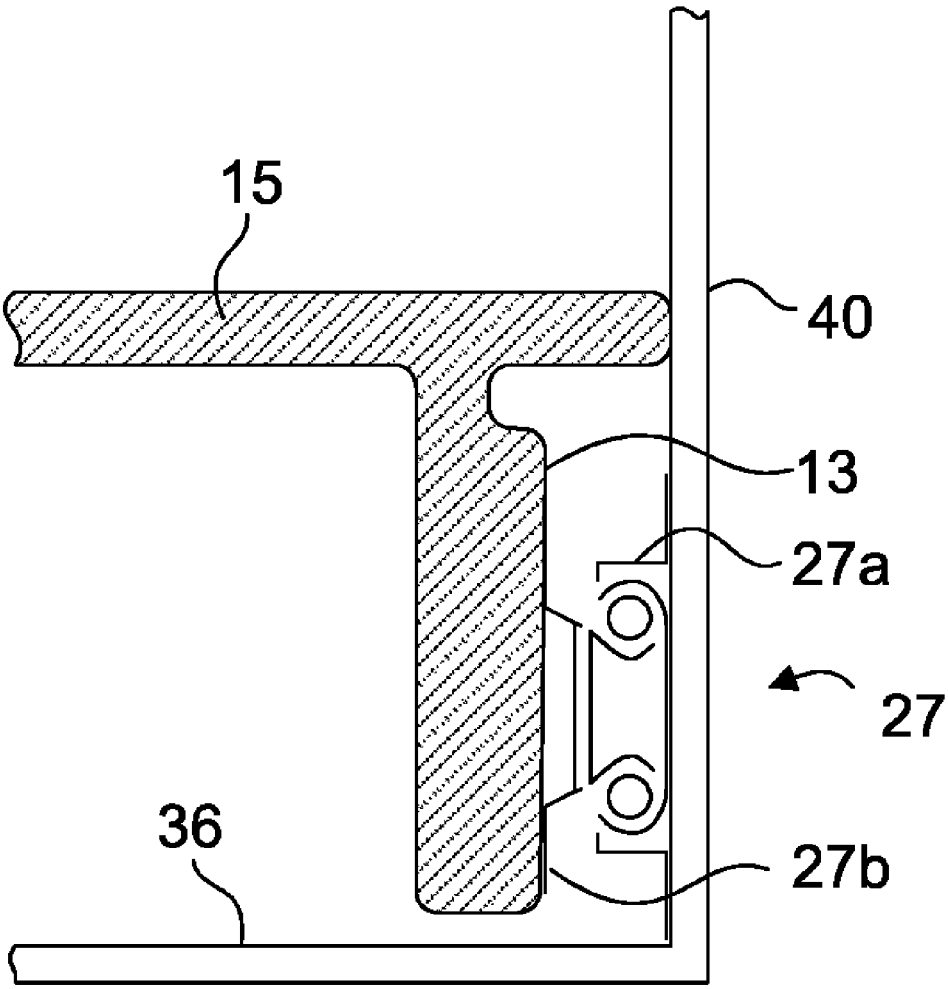
FIG. 4 is a partial front orthogonal cutaway view of another embodiment of the slideable tray and its sliding means.

FIG. 4 discloses yet another embodiment of slideable tray sliding means. FIG. 4 is a partial front orthogonal cutaway view of another embodiment of the slideable tray 10 and its sliding means. In this embodiment, a ubiquitous cabinet drawer slide 27 having a cabinet member 27*a* and a drawer member 27*b*, is provided. The cabinet member 27*a* is fixedly attached to the sidewall 40 and the drawer member 27*b* is fixedly attached to the slideable tray 10 sidewall 13.

Figure 5:
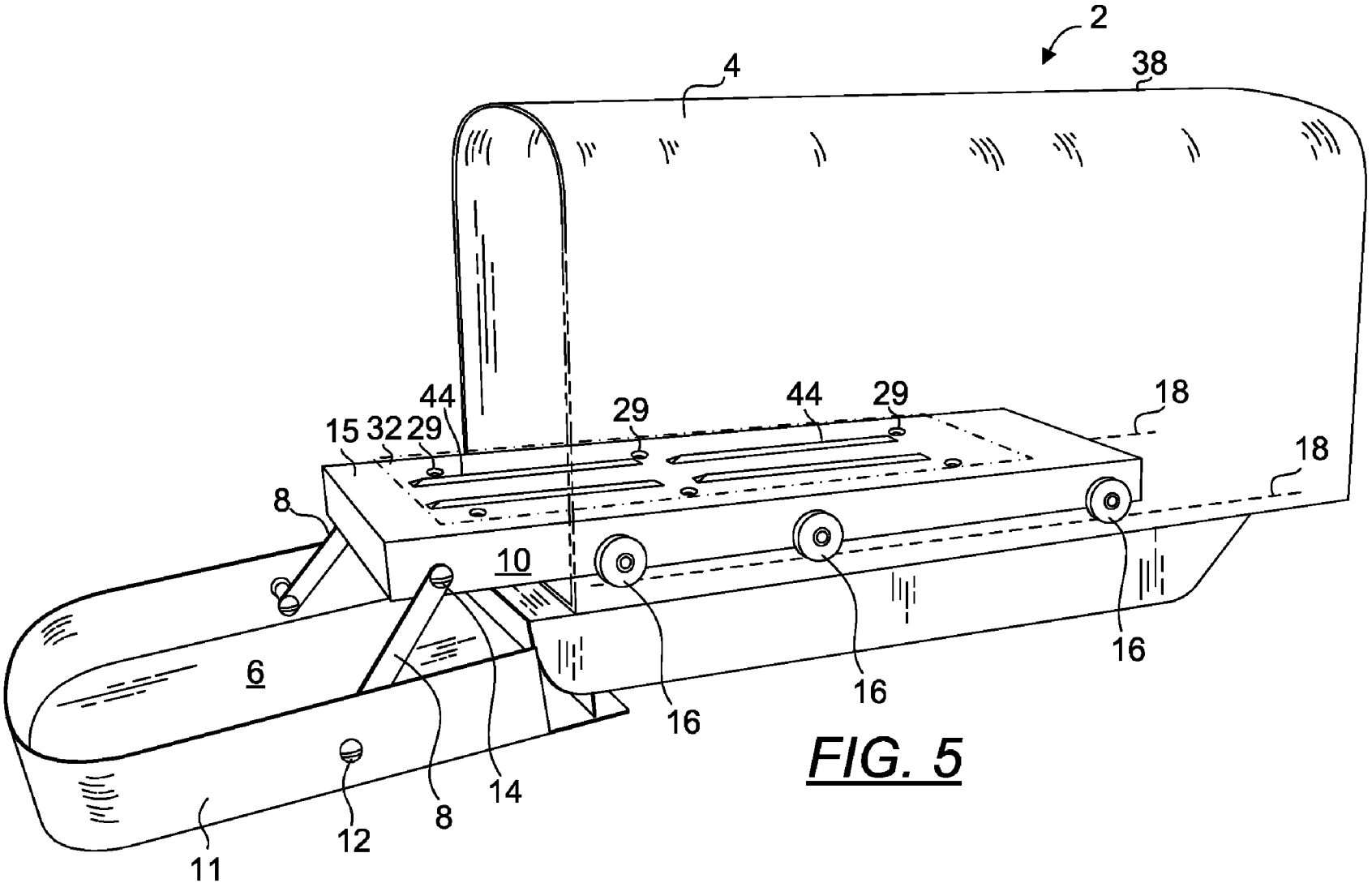
FIG. 5 is a partially transparent top front perspective view of a first embodiment of the present invention mounted in a mailbox, illustrating the spatial relationship of a slideable tray with respect to an opened front door.

FIG. 5 is a partially transparent top front perspective view of a first embodiment of the present invention mounted in a mailbox 2, illustrating the spatial relationship of a slideable tray 10 with respect to an opened front door 6. In its opened state, the front door 6 swings downwardly to expose the mailbox cavity pulling with it the bracket arms 8 which in turn cause the slideable tray 10 to be positioned partially outside of the mailbox cavity. As a result, the mail piece 32 protrudes partially outside of the mailbox cavity. This protrusion affords the identification of the mailbox contents by a user located on a side of the mailbox and negates the need to position oneself in front of the mailbox which may be undesirable under certain circumstances, especially along busy roads when retrieving mail from street side mailboxes. Upon identifying the contents, the partial protrusion of the mail piece 32 outside of the mailbox 2 facilitates mail retrieval. The user is not required to extend his/her hand inside the mailbox in order to retrieve a mail piece. The placement of the rollers 16 on the sidewalls 13 of the slideable tray is configured such that the tray's travel is uninhibited by the rollers 16. In the present configuration, 20% to 50% of slideable tray 10 can be extended outside of the mailbox cavity.

Figure 6:
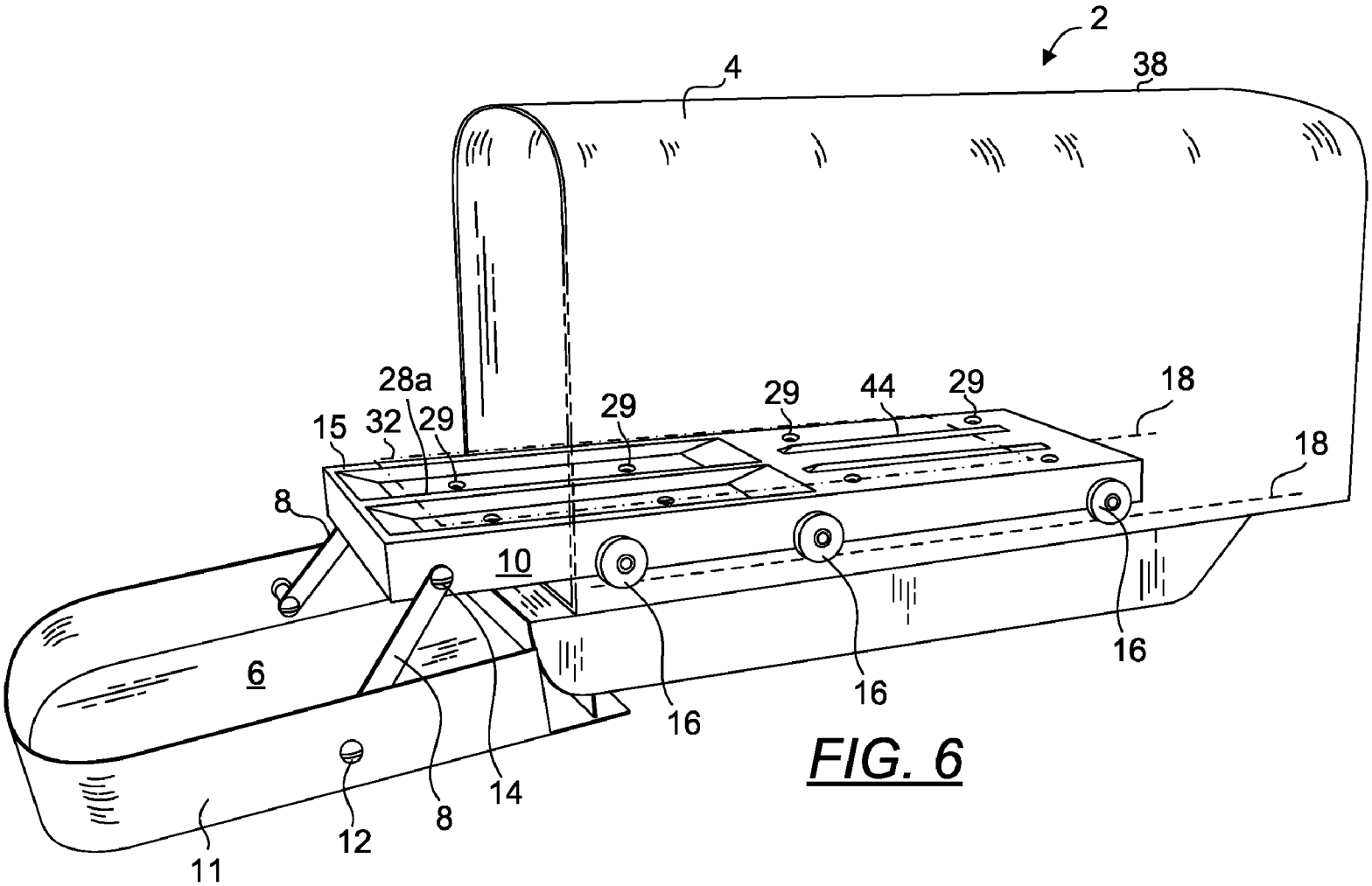
FIG. 6 is a partially transparent top front perspective view of a variation of the first embodiment of the present invention mounted in a mailbox, illustrating the incorporation of a novel feature which improves upon one's ability to quickly retrieve mail.

FIG. 6 is a partially transparent top front perspective view of a variation of the first embodiment of the present invention mounted in a mailbox 2, illustrating the incorporation of a novel feature which improves upon a user's ability to quickly retrieve mail. A novel slideable tray 10 surface is provided where two depressions are disposed in the widthwise direction of the tray leaving a ridge 28*a* to support a mail piece 32. The depth of the depressions 28 is configured such that normal sized fingers can be placed under the mail piece 32 to facilitate grasping of the mail piece 32 and subsequent removal of it from the mailbox 2. Although one depression 28 is sufficient in providing this mail handling feature, two depressions 28 are used to facilitate left and right-handed mail retrieval. The depression feature is especially advantageous for users with limited or restricted hand/finger dexterity and those wearing gloves.

Figure 7:
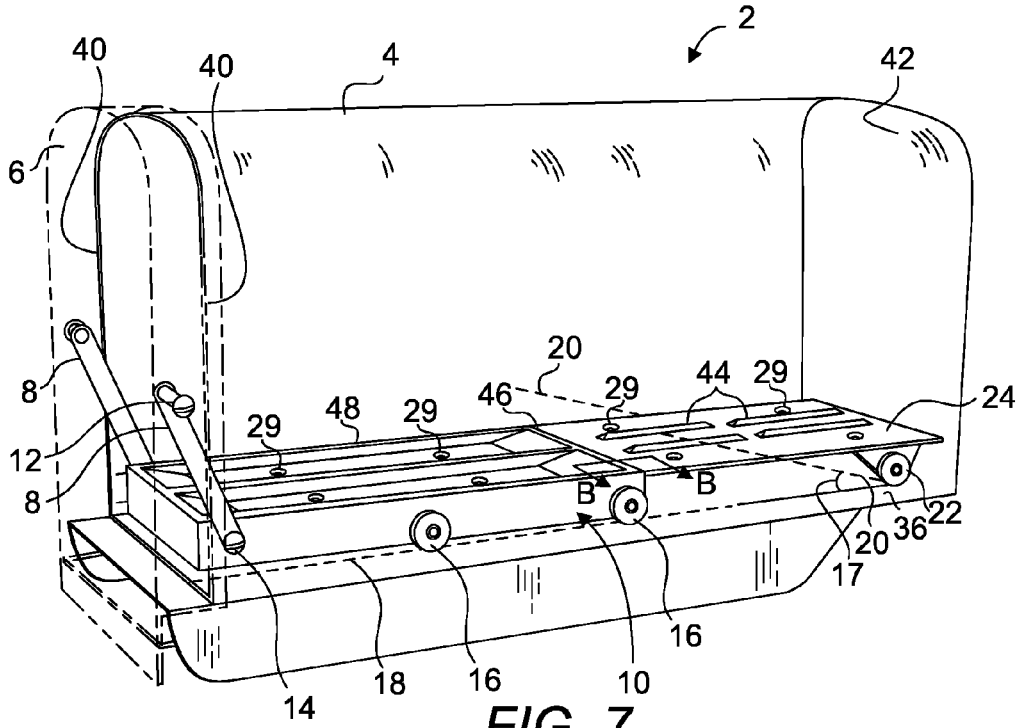
FIG. 7 is a partially transparent top front perspective view of a second embodiment of the present invention mounted in a mailbox, illustrating the spatial relationship of a slideable tray with respect to a closed front door.
Figure 8:
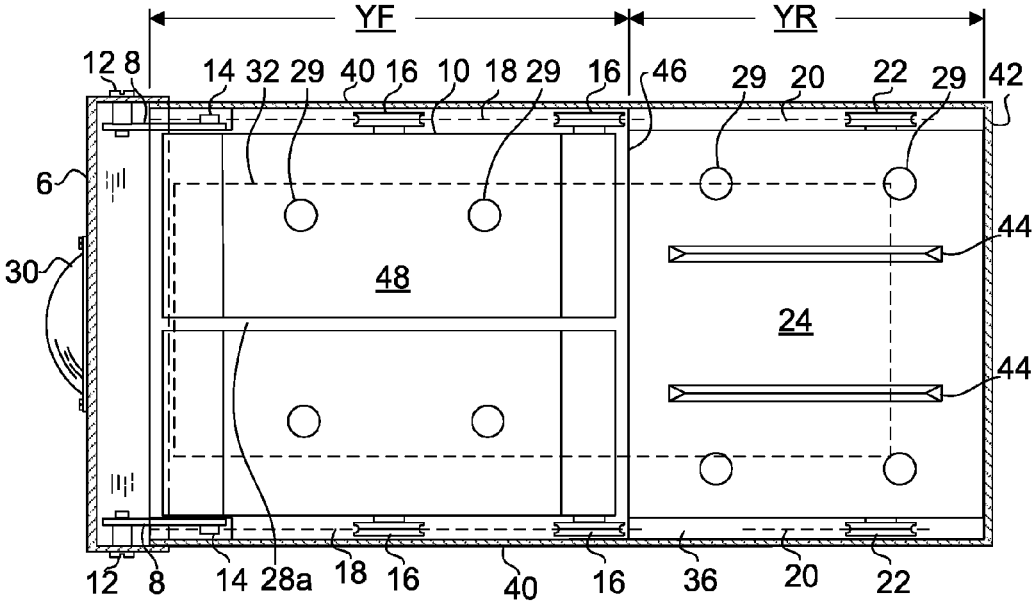
FIG. 8 is a partially transparent top orthogonal view of a second embodiment of the present invention mounted in a mailbox, illustrating the spatial relationship of a slideable tray with respect to a closed front door.

FIGS. 7 and 8 are partially transparent top front perspective and top orthogonal views, respectively, of a second embodiment of the present invention mounted in a mailbox, illustrating the spatial relationship of a slideable tray 10 with respect to a closed front door 6. In this embodiment, the slideable tray 10 is articulated. In this second embodiment, the slideable tray 10 further comprises a front segment 48 having a mail-facing surface, a front end, a rear end, a first sliding means, a rear segment 24 having a mail-facing surface, a front end, a rear end and a second sliding means.

The front end of the first segment is pivotably connected to the second end 14 of each bracket arm 8. The rear end of the front segment 48 is pivotably connected to the front end of the rear segment 24 and the first end 12 of each bracket arm 8 is pivotably connected to the front door 6 such that when the front door 6 is opened, at least a portion of the front segment 48 is extended outside of the mailbox cavity and when the front door 6 is closed, the slideable tray 10 is returned in its entirety inside the mailbox cavity.

The rear end of the rear segment 24 tilts progressively as the front door 6 is pulled by a door handle 30 until a point where the grade made between the rear and front segments is 45 degrees. Further, in order to create the proper tilt motion of the rear segment 24, the first sliding means is preferably restrained (for example, using sliding means disclosed in FIGS. 3 and 4) such that the front segment 48 travels only in a plane substantially parallel to the bottom panel 36.

Figure 9:
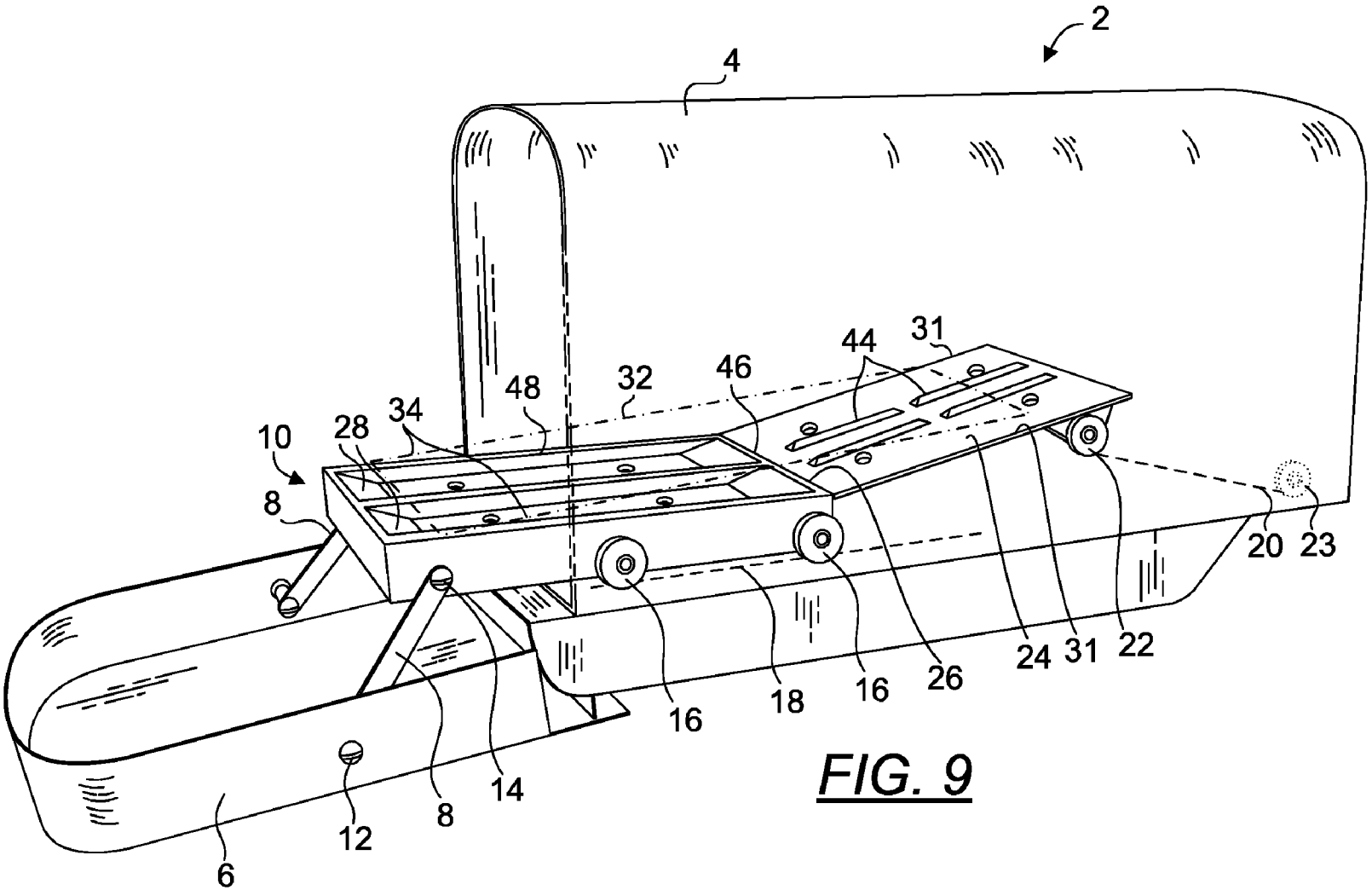
FIG. 9 is a partially transparent top front perspective view of a second embodiment of the present invention mounted in a mailbox, illustrating the spatial relationship of a slideable tray with respect to an opened front door.

FIG. 9 is a partially transparent top front perspective view of a second embodiment of the present invention mounted in a mailbox 2, illustrating the spatial relationship of a slideable tray with respect to an opened front door 6. Referring to FIGS. 7, 8 and 9 collectively, the first sliding means is aligned substantially parallel to the top surface of the bottom panel 36 and the second sliding means is aligned at an angle 17 to the first sliding means such that when the front door is opened, at least a portion of the front segment 48 is extended outside of the cavity and the mail-facing surface of the front segment 48 is substantially parallel to the top surface of the bottom panel 36 and the mail-facing surface of the rear segment 24 is substantially angled with respect to the front segment to form a collective front and rear segment concave mail-facing surface. When the front door 6 is closed, the rear segment 24 returns to an orientation substantially coplanar with the front segment 48.

In one embodiment, the second sliding means is a tilt track 20 and roller 16 combination (such as the setup disclosed in FIG. 2) where a tilt track is mounted on each sidewall 40 at an angle 17 to a level track 18. In this embodiment, each tilt track 20 is accommodated by providing a cutout on a sliding edge 31 of the rear segment 24. As illustrated in FIGS. 7, 8 and 9, the mail-facing surface of the front segment further comprises two depressions 28 disposed in the widthwise direction of the front segment 48. The depressions 28 are configured sufficiently deep such that fingers may be placed within each of the depressions 28 to facilitate securement and removal of a mail piece 32 placed on the mail-facing surface of the front segment 48. The combined effects of having at least a depression 28 in the mail-facing surface of the front segment 48 and tilting of the rear segment 24 create sufficient gap for any size fingers or a hand to be placed underneath the mail piece 32 for easy grip of the mail piece 32 for subsequent removal. The tilt angle is preferably ranging from 10 degrees to 45 degrees and the length ratio of the front segment and the rear segment YF/YR preferably ranges from 2/3 to 3/2.

There are further provided a plurality of drain holes 29 on the mail-facing surfaces the front and rear segments 48, 24. In addition, there are further provided ridges 44 on the mail-facing surface of the rear segment 24 to help elevate the mail piece 32 above the mail-facing surface to minimize contact of the mail piece 32 with any moisture or water from condensation, rain or melted snow that may collect on the mail-facing surfaces of the front and rear segments 48, 24.

Figure 10:
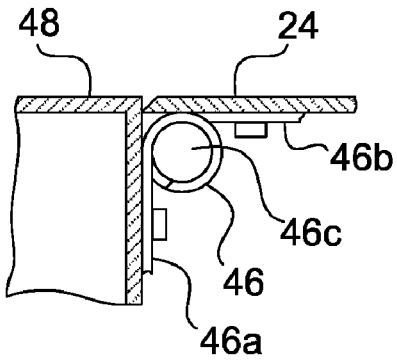
FIG. 10 is a partial orthogonal side cutaway view of a hinge that connects a front segment to a rear segment of an articulated slideable tray taken along line BB of FIG. 7.
Figure 11:
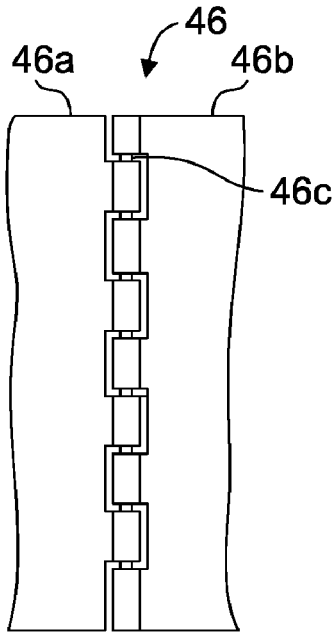
FIG. 11 is a partial orthogonal bottom view of a hinge that connects a front segment to a rear segment of an articulated slideable tray of FIGS. 7, 8 and 9.

FIGS. 10 and 11 are partial orthogonal side and bottom cutaway views, respectively, of one embodiment of a hinge that connects a front segment 48 to a rear segment 24 of an articulated slideable tray 10. FIG. 10 is an exemplary view taken along line BB of FIG. 7. In this embodiment, the hinge 46 is a conventional barrel hinge comprising two leaves 46*a*, 46*b*, each leaf having a hollow section where a pin 46*c* is inserted to secure the two leaves together. One leaf is fixedly secured to the front segment 48 and another to the rear segment 24 of the slideable tray 10. It is to be appreciated that there may be other equivalent structures to create a hinge. However, the novelty lies in the structure that makes a mail piece 32 more easily gripped and accessible. In another embodiment not shown, the front segment 48 and rear segment 24 are formed as a single unit where the hinge 46 connecting the two segments 48, 24 is a living hinge.

Figure 12:
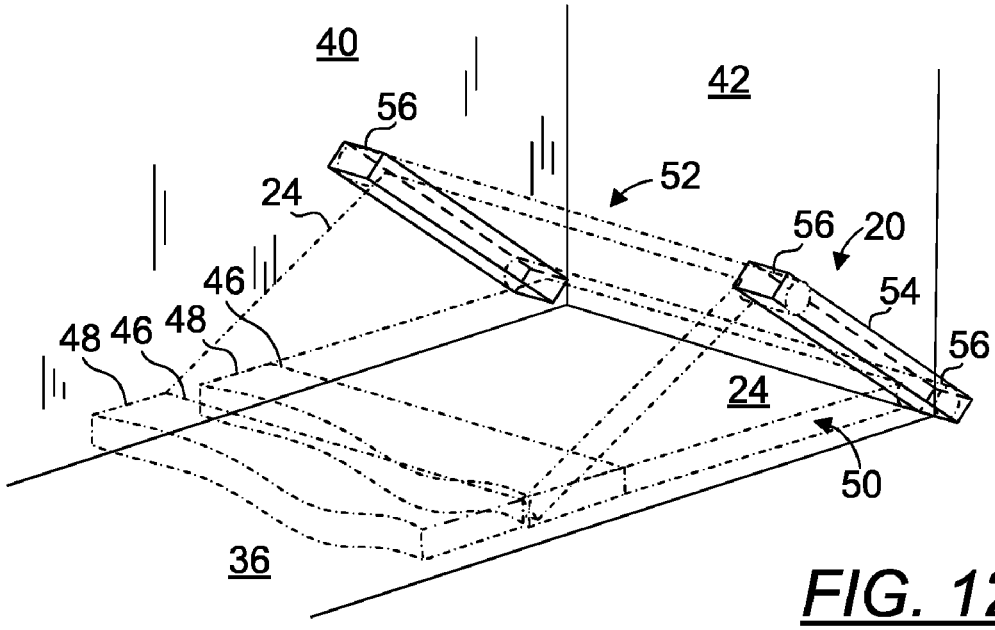
FIG. 12 is a partial transparent perspective view of another embodiment of the second sliding means as it is mounted in a mailbox.

FIG. 12 is a partial transparent perspective view of another embodiment of the second sliding means. In order to more clearly depict the second sliding means, it is depicted in positions corresponding to both an opened and closed front door. Positions 50 and 52 correspond to a closed and opened front door respectively. In this embodiment, there is provided a slot-and-pin type system such that the sliding edges 31 of the rear segment 24 may be brought to sliding abutment with sidewalls 40. As illustrated, a pair of parallelly configured slots 54 is built into sidewalls 40 such that there is no protrusion to cause interference with the tightly abutted rear segment 24. A sliding pin 56 capable of sliding in the slots 54 is disposed at the rear end of the rear segment 24 to facilitate tilting of the rear segment 24 going from position 50 to 52 and reseating of the rear segment 24 going from position 52 to 50.

In view of the foregoing descriptions, it is apparent that the problem of having to focus straight on into a mailbox cavity in order to identify the contents of a mailbox is eliminated by having a mail piece extending device which brings at least a portion of a mail piece out for rapid identification. A user is therefore not required to approach the mailbox from the front and peer into the mailbox cavity but can simply approach from a side of the mailbox and proceed to pick up the mail.

Having at least a depression 28 adjacent to an elevated portion 28*a* substantially disposed in the middle of the tray elevates a mail piece to a point where one is able to insert fingers underneath the mail piece 32 for easy gripping and subsequent removal of the mail piece 32 from the mailbox. U.S. Pat. No. 908,543 discloses a mailbox whose entire contents can be moved to and tilted on the outside of the mailbox. In practice, there are times when it is undesirable to move the entire contents outside of the mailbox cavity such as during snow or rain storms. In contrast to this prior art however, the present invention has a tray that remains safely inside the mailbox cavity for the most part but takes advantage of using at least a depression which makes mail collecting easier. In the second embodiment of the present mailbox, the effects of elevating the mail piece 32 are further enhanced by having a tray that has a tiltable rear segment. When delivered to a mailbox, a mail piece typically falls on top of the tray spanning the front 48 and the rear 24 segments. When the rear segment 24 tilts, the rear end of a mail piece 32 is lifted such that a larger gap is created between the mail piece 32 and the slideable tray 10 while the mail piece 32 is supported at the front end and the rear end by the front segment 48 and rear segment 24 respectively.

The mailbox tray 10 can be made of a number of materials and processes well-known in the art. The slideable tray 10 and bracket arms may be injection molded as a single piece from plastic or cut into shape from sheet metal. In some embodiments, the first and second sliding means may be formed as a single unit with their corresponding segments.

Other Embodiments

In one embodiment not shown, the rear end of the slideable tray 10 of FIG. 1 or rear segment 24 of FIGS. 7, 8 and 9 further comprises a wall disposed at right angle to the mail-facing surfaces to further ensure that the mail piece 32 is pushed forward towards the user when the front door 6 is opened.

In yet another embodiment not shown, the bottom panel is eliminated altogether, leaving the slideable tray 10 or combination of the front and rear segments 48, 24 to form a bottom barrier to protect the contents of the mailbox 2 from outside elements.

In yet another embodiment not shown, the slideable tray 10 and its associated sliding means and its connection to the front door 6 are manufactured as a single integral unit and capable of being retrofitted to an existing mailbox without the need to modify the existing mailbox.

It will be appreciated by those skilled in the art that while the invention has been described above in connection with particular embodiments the invention is not necessarily so limited and that numerous other embodiments, uses, modifications and departures from the embodiments, and uses may be made without departing from the inventive concepts.

The invention claimed is:

1. A mailbox tray mountable to a mailbox, said mailbox having a cavity defined by two sidewalls, a depending top panel, a depending bottom panel, a depending rear panel, a front door pivotably connected to the bottom panel, said mailbox tray comprising:

at least one bracket arm having a first end and a second end;

a substantially thin slideable tray is disposed substantially on a top surface of said bottom panel of said mailbox, wherein said slideable tray further comprises a front segment having a mail-facing surface, a front end, a rear end and a first sliding means and a rear segment having a mail-facing surface, a front end, a rear end and a second sliding means, wherein said front end of said front segment is pivotably connected to said second end of said at least one bracket arm, said rear end of said front segment is pivotably connected to said front end of said rear segment and said first end of said at least one bracket arm is pivotably connected to said front door such that when said front door is opened, at least a portion of said front segment is extended outside of said cavity and said rear end of said rear segment is raised and when said front door is closed, said slideable tray is returned in its entirety inside said cavity in a plane substantially parallel to said bottom panel of said mailbox.

2. The mailbox tray of claim 1, wherein said first sliding means is aligned substantially parallel to the top surface of said bottom panel and said second sliding means is aligned at an angle to said first sliding means such that when said front door is opened, at least a portion of said front segment is extended outside of said cavity and said mail-facing surface of said front segment is substantially parallel with the top surface of said bottom panel and said rear end of said rear segment is substantially raised such that the mail-facing surfaces of said front and rear segments collectively form a concave configuration and when said front door is closed, said rear segment returns to a plane substantially coplanar with said front segment.

3. The mailbox tray of claim 1, wherein said first sliding means comprises a track-and-roller system.

4. The mailbox tray of claim 1, wherein said second sliding means comprises a track-and-roller system.

5. The mailbox tray of claim 1, wherein said mail-facing surface of said front segment further comprises at least one depression substantially deep such that fingers may be placed within said at least one depression to facilitate securement and removal of a mail piece placed on said mail-facing surface.

6. The mailbox tray of claim 1, wherein said mail-facing surface of said rear segment further comprises at least one drain hole.

7. The mailbox tray of claim 1, wherein said mail-facing surface of said rear segment further comprises at least one ridge.

* * * * *